US010625395B2

(12) United States Patent
Shinozaki

(10) Patent No.: US 10,625,395 B2
(45) Date of Patent: Apr. 21, 2020

(54) SUBSTRATE POLISHING APPARATUS

(71) Applicant: EBARA CORPORATION, Tokyo (JP)

(72) Inventor: Hiroyuki Shinozaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 126 days.

(21) Appl. No.: 15/714,876

(22) Filed: Sep. 25, 2017

(65) Prior Publication Data

US 2018/0093363 A1 Apr. 5, 2018

(30) Foreign Application Priority Data

Sep. 30, 2016 (JP) ..... 2016-193258

(51) Int. Cl.
*B24B 49/18* (2006.01)
*B24B 53/00* (2006.01)
*B24B 53/12* (2006.01)

(52) U.S. Cl.
CPC ..... *B24B 49/186* (2013.01); *B24B 49/18* (2013.01); *B24B 53/005* (2013.01); *B24B 53/12* (2013.01)

(58) Field of Classification Search
CPC ..... B24B 49/18; B24B 49/186; B24B 53/005; B24B 53/017; B24B 53/02; B24B 53/12
See application file for complete search history.

(56) References Cited

U.S. PATENT DOCUMENTS 6,494,765 B2 * 12/2002 Gitis ..... B24B 37/013 451/287
6,561,875 B1 5/2003 Homma et al.
6,722,948 B1 * 4/2004 Berman ..... B24B 49/16 451/10
8,221,193 B2 * 7/2012 Chang ..... B24B 37/042 451/5
8,517,796 B2 * 8/2013 Shinozaki ..... B24B 49/08 451/443
9,108,292 B2 * 8/2015 Shimano ..... B24B 53/005
9,808,908 B2 * 11/2017 Shinozaki ..... B24B 49/18
9,849,557 B2 * 12/2017 Shinozaki ..... B24B 37/005
9,962,804 B2 * 5/2018 Shinozaki ..... B24B 37/005
(Continued)

FOREIGN PATENT DOCUMENTS

JP 2000-311876 A 11/2000
JP 2004-142083 A 5/2004
(Continued)

OTHER PUBLICATIONS

Singapore Patent Application No. 10201707289X; Written Opinion Search Report; dated Nov. 19, 2019; 7 pages.
(Continued)

*Primary Examiner* — Joseph J Hail
(74) *Attorney, Agent, or Firm* — BakerHostetler

(57) ABSTRACT

According to an aspect of the present disclosure, a substrate polishing apparatus is provided. The substrate polishing apparatus includes a turntable for supporting a polishing pad, a dresser that dresses the polishing pad, a dresser drive module that presses the dresser against the polishing pad and rotates the dresser, a support member that supports the dresser drive module, and a plurality of force sensors which are provided between the dresser drive module and the support member and each of which outputs information related to each of forces in three axis directions.

19 Claims, 8 Drawing Sheets

(56) References Cited

U.S. PATENT DOCUMENTS

| | | | | |
|---|---|---|---|---|
| 10,016,871 | B2 * | 7/2018 | Shinozaki | B24B 37/005 |
| 2004/0132309 | A1 * | 7/2004 | Sakuma | B24B 53/017 438/692 |
| 2010/0311309 | A1 | 12/2010 | Shinozaki | |
| 2011/0275289 | A1 | 11/2011 | Seo et al. | |
| 2012/0309267 | A1 | 12/2012 | Shinozaki et al. | |
| 2014/0065931 | A1 | 3/2014 | Shinozaki | |
| 2016/0184961 | A1 | 6/2016 | Shinozaki | |
| 2016/0256976 | A1 | 9/2016 | Shinozaki | |
| 2016/0271749 | A1 | 9/2016 | Shinozaki | |
| 2018/0297170 | A1 * | 10/2018 | Chen | B24B 53/017 |
| 2018/0345454 | A1 * | 12/2018 | Chen | B24B 49/16 |
| 2019/0160625 | A1 * | 5/2019 | Hu | B24B 37/005 |

FOREIGN PATENT DOCUMENTS

| | | | |
|---|---|---|---|
| JP | 2005-022028 | A | 1/2005 |
| JP | 2006-269906 | A | 10/2006 |
| JP | 4596228 | B2 | 10/2010 |
| JP | 2010-280031 | A | 12/2010 |
| JP | 2012-250309 | A | 12/2012 |
| JP | 2014-042968 | A | 3/2014 |
| JP | 2016-124063 | A | 7/2016 |
| JP | 2016-129931 | A | 7/2016 |
| JP | 2016-144860 | A | 8/2016 |
| JP | 2016-175146 | A | 10/2016 |
| WO | WO 2001/015865 | A1 | 3/2001 |

OTHER PUBLICATIONS

Japan Patent Application No. 2016-193258; Reasons for Refusal; dated Feb. 18, 2020; 4 pages.

* cited by examiner

SUBSTRATE POLISHING APPARATUS

CROSS-REFERENCE TO RELATED APPLICATIONS

This application claims the benefit of Japanese Priority Patent Application JP 2016-193258 filed on Sep. 30, 2016, the entire contents of which are incorporated herein by reference.

FIELD

The present disclosure relates to a substrate polishing apparatus.

BACKGROUND AND SUMMARY

A substrate polishing apparatus polishes a surface of a substrate by pressing the substrate against a polishing pad attached to a turntable. As a surface condition of the polishing pad may be changed by polishing the substrate, the substrate polishing apparatus has a dresser that dresses the surface of the polishing pad to perform dressing on the surface so that the surface becomes suitable for polishing.

The dressing may be performed in parallel with processing of the substrate (so-called in-situ dressing), or may be performed after processing a substrate and before processing the next substrate (so-called ex-situ dressing). Further, there is dressing that peels a surface layer of a new polishing pad so that the polishing pad easily holds polishing liquid (so-called pad break-in process).

In any dressing, it may not be possible to obtain the same dressing result even when the dressing is performed under a constant control condition (recipe). Therefore, it is desirable to monitor a force when the dresser dresses the polishing pad.

In view of the problem as described above, it is desirable to provide a substrate polishing apparatus that can monitor a force when the dresser dresses the polishing pad.

A substrate polishing apparatus according to one embodiment includes: a turntable for supporting a polishing pad; a dresser that dresses the polishing pad; a dresser drive module that presses the dresser against the polishing pad and rotates the dresser; a support member that supports the dresser drive module; and a plurality of force sensors which are provided between the dresser drive module and the support member, each of the plurality of force sensors outputting information related to each of forces in three axis directions.

A substrate polishing apparatus according to another embodiment includes: a turntable for supporting a polishing pad; a dresser that dresses the polishing pad; a dresser drive module that presses the dresser against the polishing pad and rotates the dresser; a support member that supports the dresser drive module; a plurality of force sensors which are provided between the dresser drive module and the support member, each of the plurality of force sensors outputting third information related to a force component in a direction from the polishing pad to the dresser; and a second pad dressing force calculator that calculates a force for the dresser to dress the polishing pad, based on the third information outputted from the plurality of force sensors and distances between each of the plurality of force sensors and a dressing surface of the dresser.

DETAILED DESCRIPTION

Figure 1:
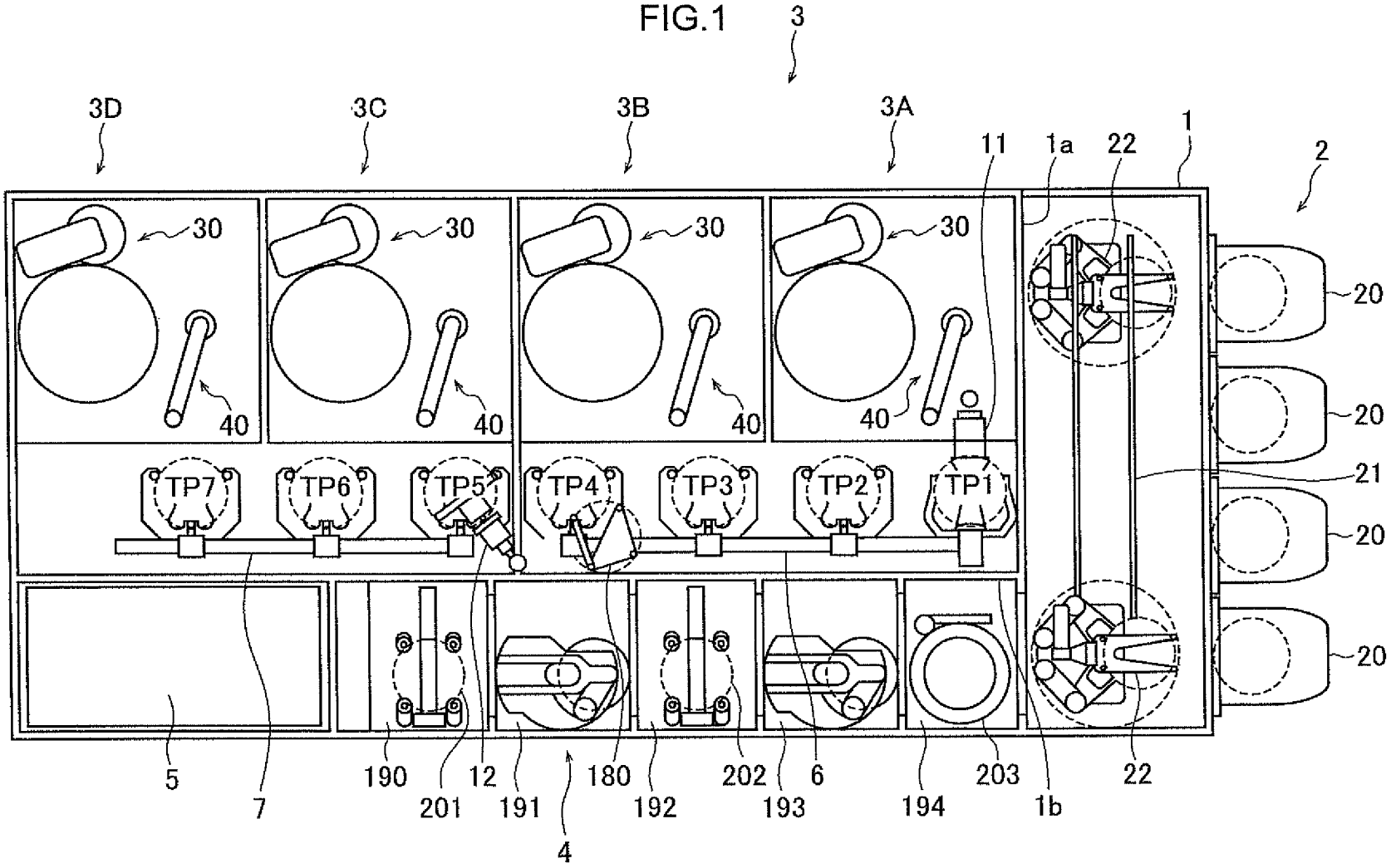
FIG. 1 is a schematic plan view of a substrate processing apparatus having substrate polishing apparatuses 3A to 3D according to a first embodiment.

A substrate polishing apparatus according to one embodiment of the present disclosure includes: a turntable for supporting a polishing pad; a dresser that dresses the polishing pad; a dresser drive module that presses the dresser against the polishing pad and rotates the dresser; a support member that supports the dresser drive module; and a plurality of force sensors which are provided between the dresser drive module and the support member, each of the plurality of force sensors outputting information related to each of forces in three axis directions.

A three-axis force sensor is provided between the dresser drive module and the support member of the dresser drive module, and thereby it is possible to monitor a magnitude and an angle of a force when the dresser dresses the polishing pad.

It is preferable that the plurality of force sensors are disposed at an identical distance from a rotating shaft of the dresser and with an equal interval angle around the rotating shaft of the dresser.

Thereby, it is possible to cancel a torque component around the rotation center when the dresser is rotated.

The plurality of force sensors may output first information related to a first force component in a first direction in a rotating plane of a dressing surface of the dresser, second information related to a second force component in a second direction perpendicular to the first direction in the rotating plane of the dressing surface of the dresser, and third information related to a third force component in a direction from the polishing pad to the dresser.

Thereby, it is possible to calculate a force component in the dressing surface.

The substrate polishing apparatus may further include a first pad dressing force calculator that calculates the first force component in the first direction of a force for each position in the dresser corresponding to an installation position of each of the plurality of force sensors, to dress the polishing pad based on the first information outputted from each of the plurality of force sensors, and the second force component in the second direction of a force for each position in the dresser corresponding to an installation position of each of the plurality of force sensors, to dress the polishing pad based on the second information outputted from each of the plurality of force sensors.

Thereby, it is possible to monitor a force for each position in the dresser to dress the polishing pad.

The substrate polishing apparatus may further include a dresser pressure reaction force calculator that calculates a reaction force generated when each position in the dresser corresponding to an installation position of each of the plurality of force sensors presses the polishing pad, based on the third information outputted from each of the plurality of force sensors.

Thereby, it is possible to monitor a force when each position in the dresser presses the polishing pad.

The substrate polishing apparatus may further include a pad dressing torque calculator that calculates a torque when the dresser dresses the polishing pad, based on the first information and the second information that are outputted from the plurality of force sensors and a positional relationship between each of the force sensors and a center of a rotating shaft of the dresser.

Thereby, it is possible to monitor a pad dressing torque.

The substrate polishing apparatus may further include a second pad dressing force calculator that calculates a force when the dresser dresses the polishing pad, based on the first information and the second information that are outputted from the plurality of force sensors.

Thereby, it is possible to monitor the force for the dresser to dress the polishing pad.

A substrate polishing apparatus according to another embodiment of the present disclosure includes: a turntable for supporting a polishing pad; a dresser that dresses the polishing pad; a dresser drive module that presses the dresser against the polishing pad and rotates the dresser; a support member that supports the dresser drive module; a plurality of force sensors which are provided between the dresser drive module and the support member, each of the plurality of force sensors outputting third information related to a force component in a direction from the polishing pad to the dresser; and a second pad dressing force calculator that calculates a force for the dresser to dress the polishing pad, based on the third information outputted from the plurality of force sensors and distances between each of the plurality of force sensors and a dressing surface of the dresser.

Even when the force sensors, which are provided between the dresser drive module and the support member of the dresser drive module, detect forces only in one direction, it is possible to monitor a magnitude and an angle of the force for the dresser to dress the polishing pad, by using distances between the force sensors and the dressing surface.

The substrate polishing apparatus may further include a determiner that performs abnormality determination by comparing a threshold value with a temporal variation of a magnitude of a force for the dresser to dress the polishing pad.

Thereby, it is possible to detect abnormality of the polishing pad.

The substrate polishing apparatus may further include: a dresser position calculator that calculates a position of the dresser on the polishing pad at each time; and an output controller that identifies and outputs a position of the dresser on the polishing pad when an abnormality is determined, based on a calculation result of the dresser position calculator and a result of the abnormality by the determiner.

Thereby, it is possible to visualize an abnormality occurrence position on the polishing pad.

The output controller may perform output taking a number of times an abnormality is determined on the polishing pad into consideration.

Thereby, it is possible to visualize an abnormality occurrence position on the polishing pad.

The second pad dressing force calculator may calculate a magnitude and a direction of the force for the dresser to dress the polishing pad, based on the first information and the second information.

The substrate polishing apparatus may further include a work calculator that calculates workload and/or power of the dresser, based on the force for the dresser to dress the polishing pad.

It is possible to monitor the workload and the power, so that it is possible to perform various determinations based on the workload and the power.

The substrate polishing apparatus may further include lifetime determiner that determines a lifetime of the dresser, based on variation of the workload and/or the power.

Thereby, it is possible to accurately determine the lifetime of the dresser.

The substrate polishing apparatus may further include a comparator that compares a threshold value with the workload and/or the power.

Thereby, it is possible to monitor whether a dressing process is good or bad.

Hereinafter, embodiments will be specifically described with reference to the drawings.

(First Embodiment)

FIG. 1 is a schematic plan view of a substrate processing apparatus having substrate polishing apparatuses 3A to 3D according to a first embodiment. As shown in FIG. 1, the substrate processing apparatus includes a housing 1 having a substantially rectangular shape, and the inside of the housing 1 is partitioned into a load/unload module 2, a polisher 3, and a cleaner 4 by partition walls 1*a* and 1*b*. Each of the load/unload module 2, the polisher 3, and the cleaner 4 is individually assembled and individually exhausted. A substrate is polished in the polisher 3. The polished substrate is cleaned and dried in the cleaner 4. Further, the substrate processing apparatus has a controller 5 that controls a substrate processing operation.

The load/unload module 2 includes two or more (four in the present embodiment) front loaders 20, in each of which a substrate cassette where many substrates (for example, semiconductor wafers) are stocked is mounted. The front loaders 20 are disposed adjacent to the housing 1 and arranged along a width direction (a direction perpendicular to a longitudinal direction) of the substrate processing apparatus.

A traveling mechanism 21 is laid along the arrangement of the front loaders 20 in the load/unload module 2, and two transfer robots (loaders) 22, which can move along an arrangement direction of the substrate cassettes, are installed on the traveling mechanism 21. The transfer robots 22 can access the substrate cassettes mounted in the front loaders 20 by moving on the traveling mechanism 21. Each transfer robot 22 has an upper hand and a lower hand. The transfer robot 22 uses the upper hand when returning a substrate after processing to the substrate cassette and uses the lower hand when extracting a substrate before processing from the substrate cassette, so that the transfer robot 22 can use the upper hand and the lower hand separately. Further, the lower hand of the transfer robot 22 can turn the substrate upside down by rotating around its axis center.

The polisher 3 is a region where the substrate is polished (flattened). For example, the polisher 3 includes four substrate polishing apparatuses 3A to 3D arranged in order from the load/unload module 2. Each of the four substrate polishing apparatuses 3A to 3D has a polishing unit 30 and a dressing unit 40. A configuration of the substrate polishing apparatuses 3A to 3D will be described later in detail.

The cleaner 4 is a region where the substrate is cleaned and dried. The cleaner 4 is partitioned into a cleaning chamber 190, a transfer chamber 191, a cleaning chamber 192, a transfer chamber 193, and a drying chamber 194, which are sequentially located from the side opposite to the load/unload module 2.

In the cleaning chamber 190, two primary substrate cleaning apparatuses 201 arranged along a perpendicular direction are disposed (only one primary substrate cleaning apparatus 201 is shown in FIG. 1). Similarly, in the cleaning chamber 192, two secondary substrate cleaning apparatuses 202 arranged along the perpendicular direction are disposed (only one secondary substrate cleaning apparatus 202 is shown in FIG. 1). The primary substrate cleaning apparatus 201 and the secondary substrate cleaning apparatus 202 are cleaning apparatuses that clean a substrate by using a cleaning liquid. As the primary substrate cleaning apparatuses 201 and the secondary substrate cleaning apparatuses 202 are arranged along the perpendicular direction, it is possible to obtain an advantage that a footprint area is small.

In the drying chamber 194, two substrate drying apparatuses 203 arranged along a vertical direction are disposed (only one substrate drying apparatus 203 is shown in FIG. 1). The two substrate drying apparatuses 203 are separated from each other. A filter fan unit that supplies clean air into the substrate drying apparatus 203 is provided in an upper portion of each substrate drying apparatus 203.

The substrate processing apparatus may include the controller 5 and control the substrate polishing apparatuses 3A to 3D and the like, or each of the substrate polishing apparatuses 3A to 3D may include a controller (a control apparatus).

Next, a transfer mechanism for transferring the substrate will be described. As shown in FIG. 1, a linear transporter 6 is disposed adjacent to the substrate polishing apparatuses 3A and 3B. The linear transporter 6 transfers the substrate between four transfer positions (defined as transfer positions TP1 to TP4 in order from the load/unload module 2) along a direction in which the substrate polishing apparatuses 3A and 3B are arranged.

Further, a linear transporter 7 is disposed adjacent to the substrate polishing apparatuses 3C and 3D. The linear transporter 7 transfers the substrate between three transfer positions (defined as transfer positions TP5 to TP7 in order from the load/unload module 2) along a direction in which the substrate polishing apparatuses 3C and 3D are arranged.

The substrate is transferred to the substrate polishing apparatuses 3A and 3B by the linear transporter 6. The substrate is transferred to and received from the substrate polishing apparatus 3A at the transfer position TP2. The substrate is transferred to and received from the substrate polishing apparatus 3B at the transfer position TP3. The substrate is transferred to and received from the substrate polishing apparatus 3C at the transfer position TP6. The substrate is transferred to and received from the substrate polishing apparatus 3D at the transfer position TP7.

A lifter 11 for receiving the substrate from the transfer robot 22 is disposed at the transfer position TP1. The substrate is transferred from the transfer robot 22 to the linear transporter 6 via the lifter 11. A shutter (not illustrated) is provided in the partition wall 1*a* between the lifter 11 and the transfer robot 22. When the substrate is transferred, the shutter is opened and the substrate is transferred from the transfer robot 22 to the lifter 11.

A swing transporter 12 is disposed between the linear transporters 6 and 7 and the cleaner 4. The swing transporter 12 has a hand that can move between the transfer positions TP4 and TP5. The substrate is transferred from the linear transporter 6 to the linear transporter 7 by the swing transporter 12.

The substrate is transferred to the substrate polishing apparatus 3C and/or the substrate polishing apparatus 3D by the linear transporter 7. The substrate that has been polished by the polisher 3 is transferred to the cleaner 4 through the swing transporter 12. A temporary placing table 180 for a substrate, which is not illustrated, is installed on a frame and is disposed beside the swing transporter 12. As shown in FIG. 1, the temporary placing table 180 is disposed adjacent to the linear transporter 6 and located between the linear transporter 6 and the cleaner 4.

Subsequently, the substrate polishing apparatuses 3A to 3D will be described in detail. The substrate polishing apparatuses 3A to 3D have the same configuration. Therefore, hereinafter, the substrate polishing apparatus 3A will be described.

Figure 2:
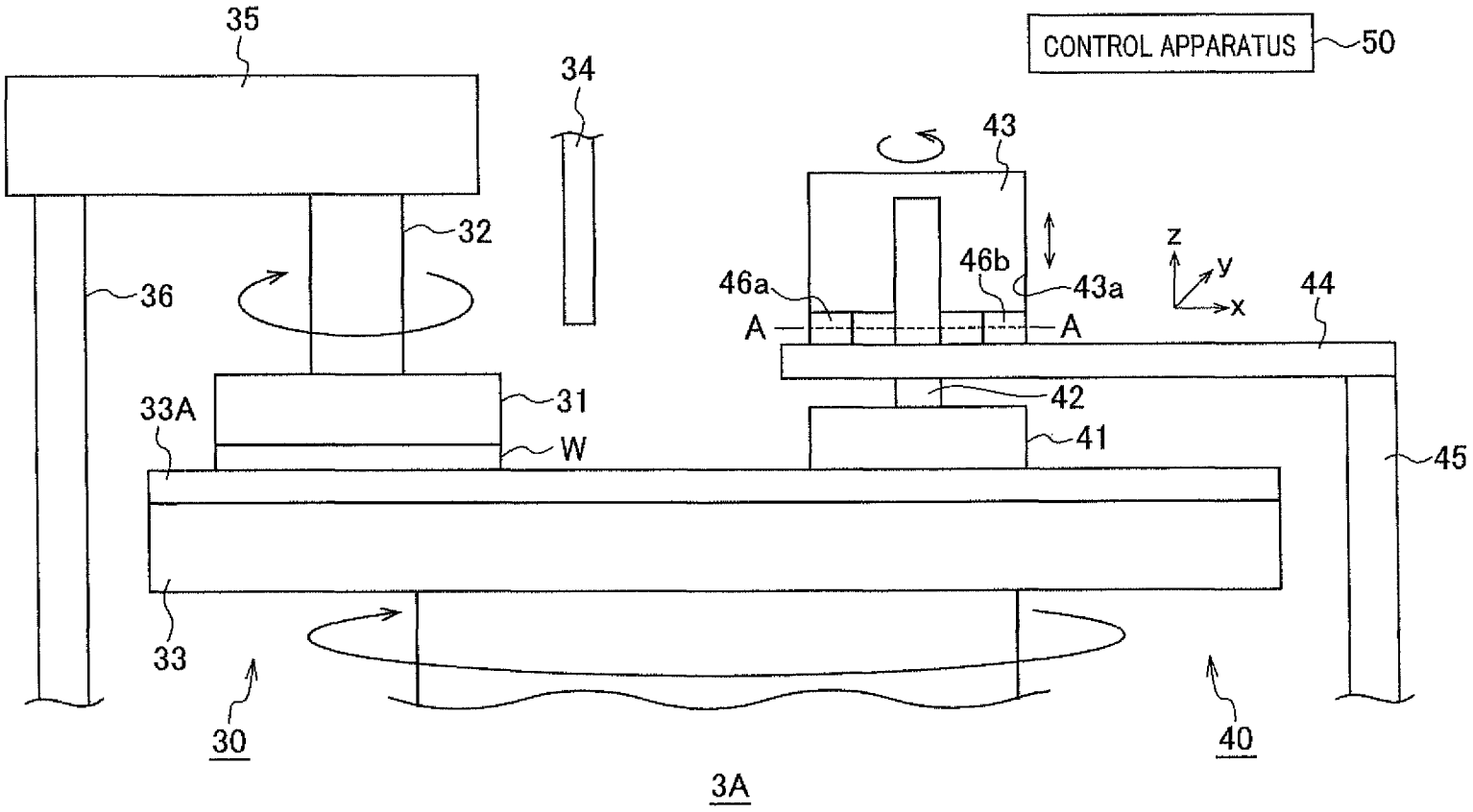
FIG. 2 is a schematic side view of the substrate polishing apparatus 3A according to the first embodiment.

FIG. 2 is a schematic side view of the substrate polishing apparatus 3A according to the first embodiment.

The substrate polishing apparatus 3A has a top ring 31, a top ring shaft 32 whose lower portion is coupled to the top ring 31, a turntable 33 supporting a polishing pad 33A, a nozzle 34 that supplies polishing liquid onto the turntable 33, a top ring arm 35, a turning shaft 36, and a control apparatus 50 that performs various control operations, as a polishing unit 30 that polishes a substrate W.

The top ring 31 holds the substrate W on its lower surface by vacuum suction.

A center portion of an upper surface of the top ring 31 is coupled to one end of the top ring shaft 32, and the top ring arm 35 is coupled to the other end of the top ring shaft 32. An elevating mechanism (not illustrated) moves up and down the top ring shaft 32 according to control of the control apparatus 50, so that a lower surface of the substrate W held by the top ring 31 comes into contact with and separates from the polishing pad 33A. Further, a motor (not illustrated) rotates the top ring shaft 32 according to control of the control apparatus 50, so that the substrate W held by the top ring 31 also rotates.

The polishing pad 33A for polishing the substrate W is provided on an upper surface of the turntable 33. A lower surface of the turntable 33 is connected to a rotating shaft, so that the turntable 33 can rotate. The substrate W is polished as a result that the polishing liquid is supplied from the nozzle 34 and the substrate W and the turntable 33 rotate in a state in which the lower surface of the substrate W is in contact with the polishing pad 33A. A surface of the polishing pad 33A may be degraded by the polishing.

The top ring shaft 32 is rotatably coupled to one end of the top ring arm 35, and the turning shaft 36 is coupled to the other end of the top ring arm 35. A motor (not illustrated) rotates the turning shaft 36 according to control of the control apparatus 50. Thus, the top ring arm 35 swings and the top ring 31 moves back and forth between a position on the polishing pad 33A and the transfer position TP2 (FIG. 1) that is a substrate transfer position.

Further, the substrate polishing apparatuses 3A has a dresser 41, a dresser shaft 42, a dresser drive module 43, a dresser arm 44, a turning shaft 45, and a plurality of force sensors 46*a* to 46c, as a dressing unit 40.

The dresser 41 has a circular cross-sectional shape. A lower surface of the dresser 41 is a dressing surface. Diamond particles or the like are fixed to the dressing surface. When the dresser 41 moves while being in contact with the polishing pad 33A, the dresser dresses the surface of the polishing pad 33A, and thereby the polishing pad 33A is dressed (conditioned).

The dresser 41 is removably coupled to a lower end of the dresser shaft 42 via a dresser holder which is not illustrated.

The dresser drive module 43 rotatably and vertically movably holds the dresser shaft 42 and elevates/lowers and rotates the dresser shaft 42. For example, the dresser drive module 43 has an elevating mechanism and a motor provided in a housing 43*a*. When the elevating mechanism lowers the dresser shaft 42 according to control of the control apparatus 50, the lower surface of the dresser 41 comes into contact with the polishing pad 33A and presses down the polishing pad 33A. When the motor rotates the dresser shaft 42 according to control of the control apparatus 50, the dresser 41 rotates while being in contact with the polishing pad 33A.

The dresser arm 44 is a support member that supports the dresser drive module 43. The dresser shaft 42 is rotatably coupled to one end of the dresser arm 44, and the turning shaft 45 is coupled to the other end of the dresser arm 44. When a motor (not illustrated) rotates the turning shaft 45 according to control of the control apparatus 50, the dresser arm 44 swings and the dresser 41 moves back and forth between a position on the polishing pad 33A and a retreat position.

As one of characteristics of the present embodiment, the plurality of force sensors 46*a* to 46*c* (only the force sensors 46*a* and 46*b* are shown in FIG. 2) for detecting forces in three axis directions are disposed between the dresser drive module 43 and the dresser arm 44 so as to be able to allow a moment load generated by a force when the dresser 41 dresses the polishing pad 33A. Preferably, the force sensors 46*a* to 46*c* are disposed below the dresser drive module 43 and above the dresser arm 44. Thereby, it is possible to prevent the dresser arm 44 from being long.

Figure 3:
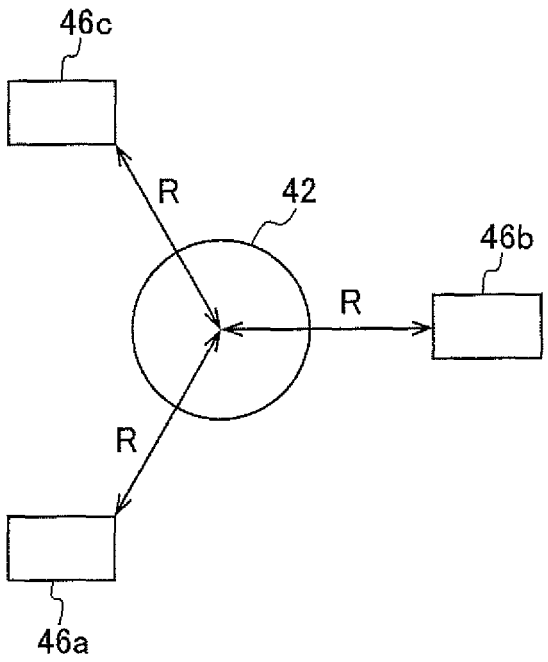
FIG. 3 is a schematic cross-sectional view of the substrate polishing apparatus 3A passing through force sensors 46*a* to 46*c* in FIG. 2.

FIG. 3 is a schematic cross-sectional view (cross-sectional view taken along line A-A) of the substrate polishing apparatus 3A passing through force sensors 46*a* to 46*c* in FIG. 2. In the present embodiment, in a horizontal plane (in other words, a rotating plane of the dressing surface of the dresser 41, the same shall apply hereinafter), the three sensors 46*a* to 46*c* are disposed at the same distance R from the center of the dresser shaft 42 and with an equal interval angle (120 degrees) around a rotating shaft of the dresser shaft 42. By disposing the sensors 46*a* to 46*c* as described above, it is possible to cancel a torque component around the rotation center when the dresser 41 is rotated.

The force sensor 46*a* outputs information Fxa' related to a force component Fxa (for example, an electric charge or a voltage proportional to the force component Fxa) in an x direction (see FIG. 2) in which the dresser arm 44 extends in the horizontal plane, information Fya' related to a force component Fya in a y direction perpendicular to the x direction in the horizontal plane, and information Fza' related to a force component Fza in a vertical direction (in other words, a direction from the polishing pad 33A to the dresser 41, hereinafter referred to as a z direction). The same goes for the force sensors 46*b* and 46*c*. Each outputted information is inputted in the control apparatus 50.

Figure 4:
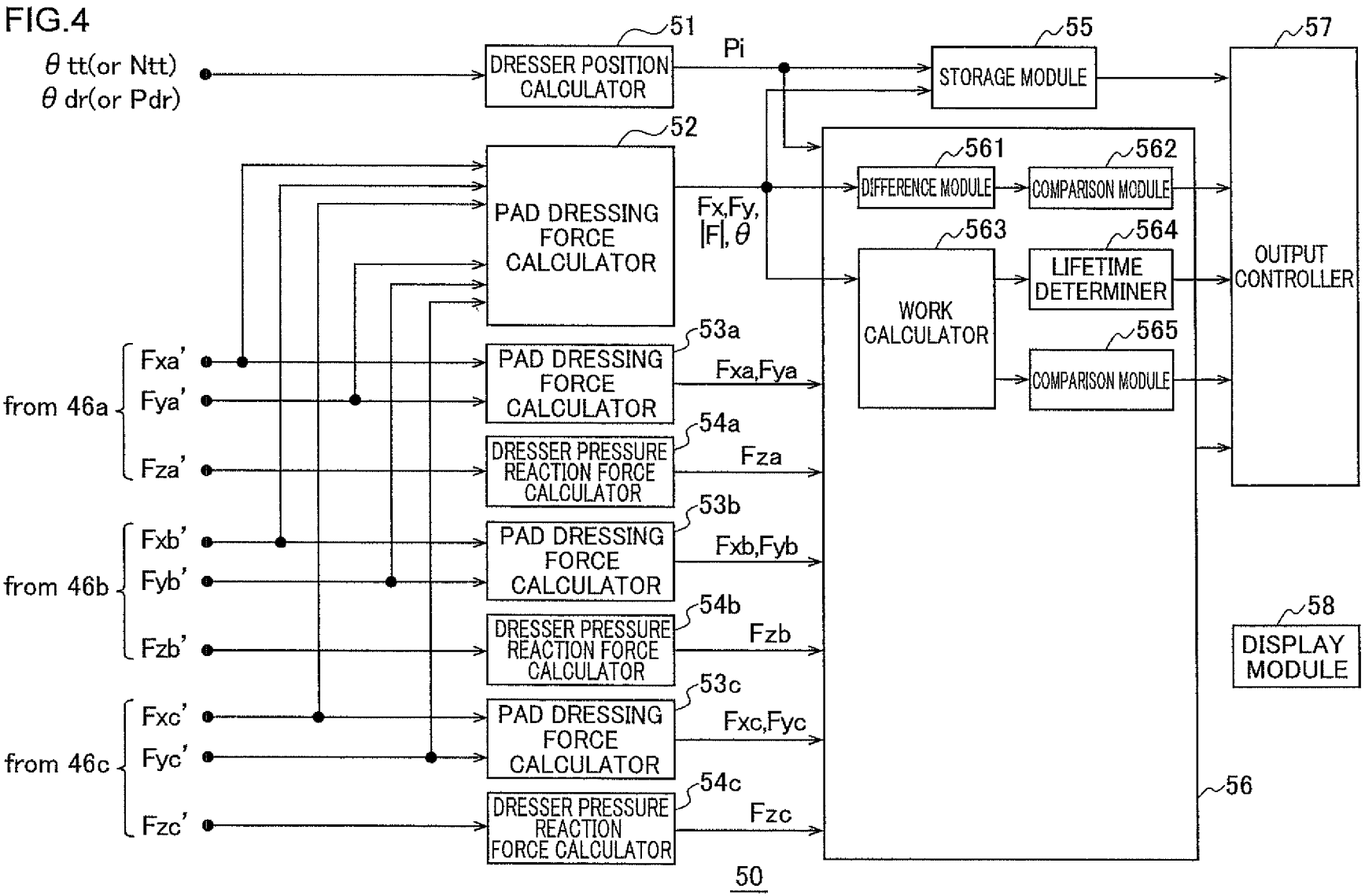
FIG. 4 is a block diagram showing a schematic configuration of a control apparatus 50.

FIG. 4 is a block diagram showing a schematic configuration of the control apparatus 50. The control apparatus 50 has a dresser position calculator 51, a pad dressing force calculators 52 and 53*a* to 53*c*, a dresser pressure reaction force calculators 54*a* to 54*c*, a storage module 55, a determiner 56, an output controller 57, and a display module 58. At least some of the above may be implemented by hardware or may be realized by software. In the latter case, each module may be realized when a processor executes a predetermined program.

The dresser position calculator 51 calculates an absolute position of the dresser 41 on the polishing pad 33A at each time. The pad dressing force calculators 52 and 53*a* to 53*c* calculate a force when the dresser 41 dresses the polishing pad 33A. The dresser pressure reaction force calculators 54*a* to 54*c* calculate a reaction force from the polishing pad 33A to the dresser 41 when the dresser 41 dresses the polishing pad 33A. The storage module 55 stores results of each calculation described above. The determiner 56 performs various determinations based on the calculation results described above. The output controller 57 generates data for outputting a determination result and the like of the determiner 56 and causes the display module 58 to display the data. The above operations will be described below in detail.

The dresser position calculator 51 calculates an absolute position Pi of the dresser 41 on the polishing pad 33A at each time ti. More specifically, a rotation angle θtt (or a rotation speed Ntt) of the turntable 33 and a turning angle θdr (or a position Pdr of the dresser 41 with respect to the turning center) of the dresser arm 44 are inputted in the dresser position calculator 51, and the dresser position calculator 51 calculates the position Pi by using a predetermined constant according to a structure of the dressing unit 40. The position Pi is outputted to the storage module 55 and the determiner 56.

The pad dressing force calculator 52 calculates a force F when the dresser 41 dresses the polishing pad 33A (hereinafter also referred to as simply a "dressing force F") based on information pieces Fxa' to Fxc' and Fya' to Fyc' which are outputted from the force sensors 46*a* to 46*c*. When a force F is simply mentioned, the force F indicates an x component Fx and a y component Fy of the force and the magnitude of the force |F| and/or the direction of the force θ. The specific processing is as follows.

First, the pad dressing force calculator 52 sums up output information pieces Fxa' to Fxc' related to the x direction of the force sensors 46*a* to 46*c* and calculates Fx'=(Fxa'+Fxb'+Fxc'). Similarly, the pad dressing force calculator 52 calculates Fy'=(Fya'+Fyb'+Fyc').

Subsequently, the pad dressing force calculator 52 calculates the x component Fx and the y component Fy of the dressing force F based on Fx' and Fy', respectively. For example, when the force sensors 46*a* to 46*c* output an electric charge proportional to a force, the pad dressing force calculator 52 converts electric charges Fx' and Fy' to voltages Vx and Vy proportional to forces Fx and Fy, respectively, by using a charge amplifier (not illustrated). Then, the pad dressing force calculator 52 converts the voltages Vx and Vy to the forces Fx and Fy, respectively.

Further, the pad dressing force calculator 52 calculates the magnitude |F| and an angle θ of the dressing force F based on the following formula.

$$|F|=\sqrt{Fx^2+Fy^2}$$

$$\theta=\tan^{-1} Fy/Fx \qquad \text{[Expression 1]}$$

The pad dressing force calculator 52 periodically receives Fxa' to Fxc' and Fya' to Fyc' from the force sensors 46*a* to 46*c*, calculates Fx, Fy, |F|, and θ, and outputs calculation results to the storage module 55 and the determiner 56.

The storage module 55 stores a dressing force Fi at a certain time ti and a position Pi of the dresser 41 at that time in association with each other based on calculation results of the pad dressing force calculator 52 and the dresser position calculator 51. Thereby, a relationship between the position of the dresser 41 on the polishing pad 33A at the certain time ti and the dressing force Fi at that time is known. The calculated dressing force F may be displayed on the display module 58 by the output controller 57.

The pad dressing force calculator 53*a* calculates an x component Fxa and a y component Fya of a force Fa for a position of the dresser 41 corresponding to an installation position of the force sensor 46*a* to dress the polishing pad 33A by using a charge amplifier as needed based on the information Fxa' and Fya' from the force sensor 46*a*. Next, the pad dressing force calculator 53*a* calculates a magnitude |F| and an angle θa of the dressing force Fa based on the following formula.

$$|Fa|=\sqrt{Fxa^2+Fya^2}$$

$$\theta a=\tan^{-1}(Fya/Fxa) \qquad \text{[Expression 2]}$$

Similarly, the pad dressing force calculator 53*b* calculates an x component Fxb and a y component Fyb of a force Fb for a position of the dresser 41 corresponding to an installation position of the force sensor 46*b* to dress the polishing pad 33A, and a magnitude |Fb| and an angle θb of the dressing force Fb. Further, similarly, the pad dressing force calculator 53*c* calculates an x component Fxc and a y component Fyc of a force Fc for a position of the dresser 41 corresponding to an installation position of the force sensor 46*c* to dress the polishing pad 33A, and a magnitude |Fc| and an angle θc of the dressing force Fc.

The determiner 56 may perform abnormality determination by comparing forces in the horizontal direction at each position of the dresser 41 based on calculation results of the pad dressing force calculators 53*a* to 53*c*. The output controller 57 may monitor an effect distribution in the horizontal plane and display a result of the monitoring on the display module 58.

The dresser pressure reaction force calculator 54*a* calculates a reaction force Fza generated when the position of the dresser 41 corresponding to the installation position of the force sensor 46*a* presses the polishing pad 33A by using a charge amplifier as needed based on the information Fxa' from the force sensor 46*a*.

Similarly, the dresser pressure reaction force calculator 54*b* calculates a reaction force Fzb generated when the position of the dresser 41 corresponding to the installation position of the force sensor 46*b* presses the polishing pad 33A. Further, similarly the dresser pressure reaction force calculator 54*c* calculates a reaction force Fzc generated when the position of the dresser 41 corresponding to the installation position of the force sensor 46*c* presses the polishing pad 33A.

The determiner 56 may perform abnormality determination by comparing pressing load at every position of the dresser 41 based on the calculation results of the dresser pressure reaction force calculators 54*a* to 54*c*. The output controller 57 may monitor an effect distribution in the horizontal plane and display a result of the monitoring on the display module 58. Further, when the dresser 41 is installed, an adjustment to make the voltages Fza to Fzc be equal to one another may be performed.

The determiner 56 may include a difference module 561 and a comparison module 562 and perform abnormality determination based on a temporal variation of the dressing force F.

The difference module 561 calculates a difference value dF between the magnitude |F| of the dressing force F at a certain time and the magnitude |F| of the dressing force F at a next certain time based on a sampling time instruction that is externally set (or that is determined in advance).

The comparison module 562 compares the difference value dF with a threshold value TH1 that is externally set (or that is determined in advance). When the difference value dF is greater than the threshold value TH1, the comparison module 562 determines that there is abnormality. When the difference value dF is greater than the threshold value TH1, there is a possibility that, for example, a pad surface will be unevenly worn or is beginning to be unevenly worn. It is possible to detect that the polishing pad 33A has an abnormality by the determination as described above. A determination result maybe outputted to the output controller 57 and displayed on the display module 58.

For example, the output controller 57 causes the display module 58 to display a predetermined screen based on data stored in the storage module 55 and a determination result of the determiner 56.

Figure 5:
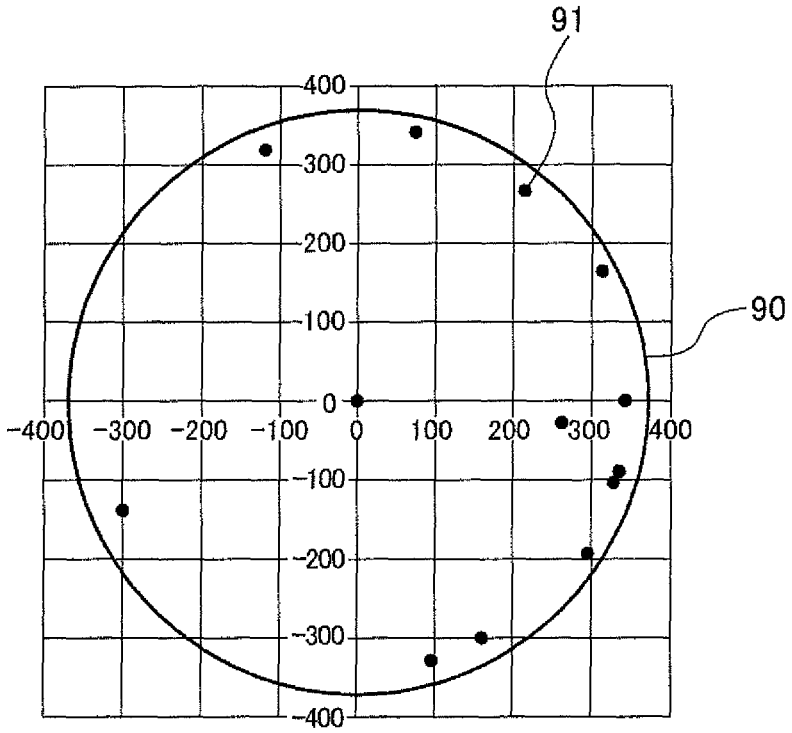
FIG. 5 is a diagram showing an example of a screen displayed on a display module 58.

FIG. 5 is a diagram showing an example of a screen displayed on the display module 58. A circle 90 in FIG. 5 represents a surface of the polishing pad 33A. The output controller 57 recognizes a position Pi of the dresser 41 on the polishing pad 33A at time ti at which an abnormality is detected by the determiner 56 based on the data stored in the storage module 55. In this way, the output controller 57 identifies a position on the polishing pad 33A at which an abnormality is detected.

Then the output controller 57 outputs positions where an abnormality is detected on the polishing pad 33A by plotting the positions to corresponding positions (reference numeral 91) in the circle 90. Thereby, abnormality occurrence positions on the polishing pad 33A are visualized.

The output controller 57 may plot a position where an abnormality occurs at a specific time or may accumulatively plot positions where an abnormality occurs within a predetermined time range. Further, the output controller 57 may perform output where an abnormality occurrence frequency is reflected. For example, the output controller 57 may plot and output only positions where the abnormality occurrence frequency exceeds a predetermined value. Thereby, an abnormality occurrence density on the polishing pad 33A is visualized.

Let us return to FIG. 4. The determiner 56 includes a work calculator 563, a lifetime determiner 564, and a comparison module 565. The determiner 56 may perform determination based on work of the dresser 41.

The work calculator 563 calculates a product of a relative displacement amount L between the dresser 41 and the polishing pad 33A in a sampling time dt (in other words, a distance in which the dresser 41 has dressed the polishing pad 33A) and a magnitude |F| of a dressing force, that is to say, a workload W of the dresser 41=|F|*L[J]. Further, the work calculator 563 may calculate power P=W/dt[W] of the dresser 41 by dividing the workload W by the sampling time dt. It is possible to determine whether a dressing process is good or bad by monitoring a relationship between the workload W and/or the power P and the position of the dresser 41 on the polishing pad 33A (a distance from the rotation center of the polishing pad 33A to the position of the dresser 41). A specific example of the determination is as follows.

Figure 6:
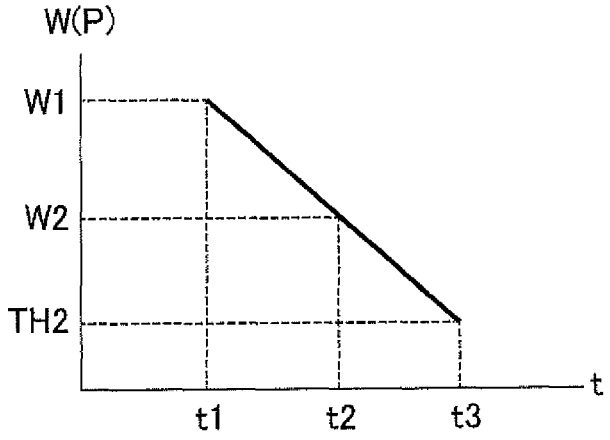
FIG. 6 is a diagram illustrating an operation of a lifetime determiner 564.

FIG. 6 is a diagram for explaining an operation of the lifetime determiner 564. The lifetime determiner 564 predicts a time t3 when the workload W reaches a threshold value TH2 from a workload W1 (or power P, the same shall apply hereinafter) at a certain time t1 and a workload W2 at the next certain time t2. The threshold value TH2 is set corresponding to the lifetime of the dresser 41 and is a value at which the dresser 41 is determined to be unusable. In this way, it is possible to predict the lifetime of the dresser 41 and recommend exchange of the dresser 41 as needed.

Let us return to FIG. 4. As another determination example, the comparison module 565 compares the workload W of the dresser 41 with an upper limit threshold value TH3 and a lower limit threshold value TH4, which are externally set (or which are determined in advance), and detects a position on the polishing pad 33A where the workload W exceeds the upper limit threshold value TH3 and/or falls below the lower limit threshold value TH4. When the workload W exceeds the upper limit threshold value TH3, there is a possibility that the dresser 41 is stuck at a specific position on the polishing pad 33A. When the workload W falls below the lower limit threshold value TH4, there is a possibility that the dresser 41 is floating at a specific position over the polishing pad 33A and the dressing is not performed. The output controller 57 may display an alarm according to a detection frequency.

The output controller 57 may display the workload W at each position on the polishing pad 33A on the display module 58. Further, the output controller 57 may recognize positions on the polishing pad 33A where the workload W exceeds the upper limit threshold value TH3 and/or falls below the lower limit threshold value TH4 and plot the positions. Alternatively, when the number of positions where the workload W exceeds the upper limit threshold value TH3 and/or falls below the lower limit threshold value TH4 exceeds a predetermined number, the output controller 57 may plot the positions.

As described above, in the first embodiment, the force sensors 46*a* to 46*c* are provided between the dresser drive module 43 and the dresser arm 44. Thereby, it is possible to accurately monitor the force F for the dresser 41 to dress the polishing pad 33A (in particular, the magnitude |F| and the angle θ of the force F) and utilize the force F for various determinations.

The installation positions of the force sensors are not limited to the installation positions shown in FIG. 2.

Figure 7:
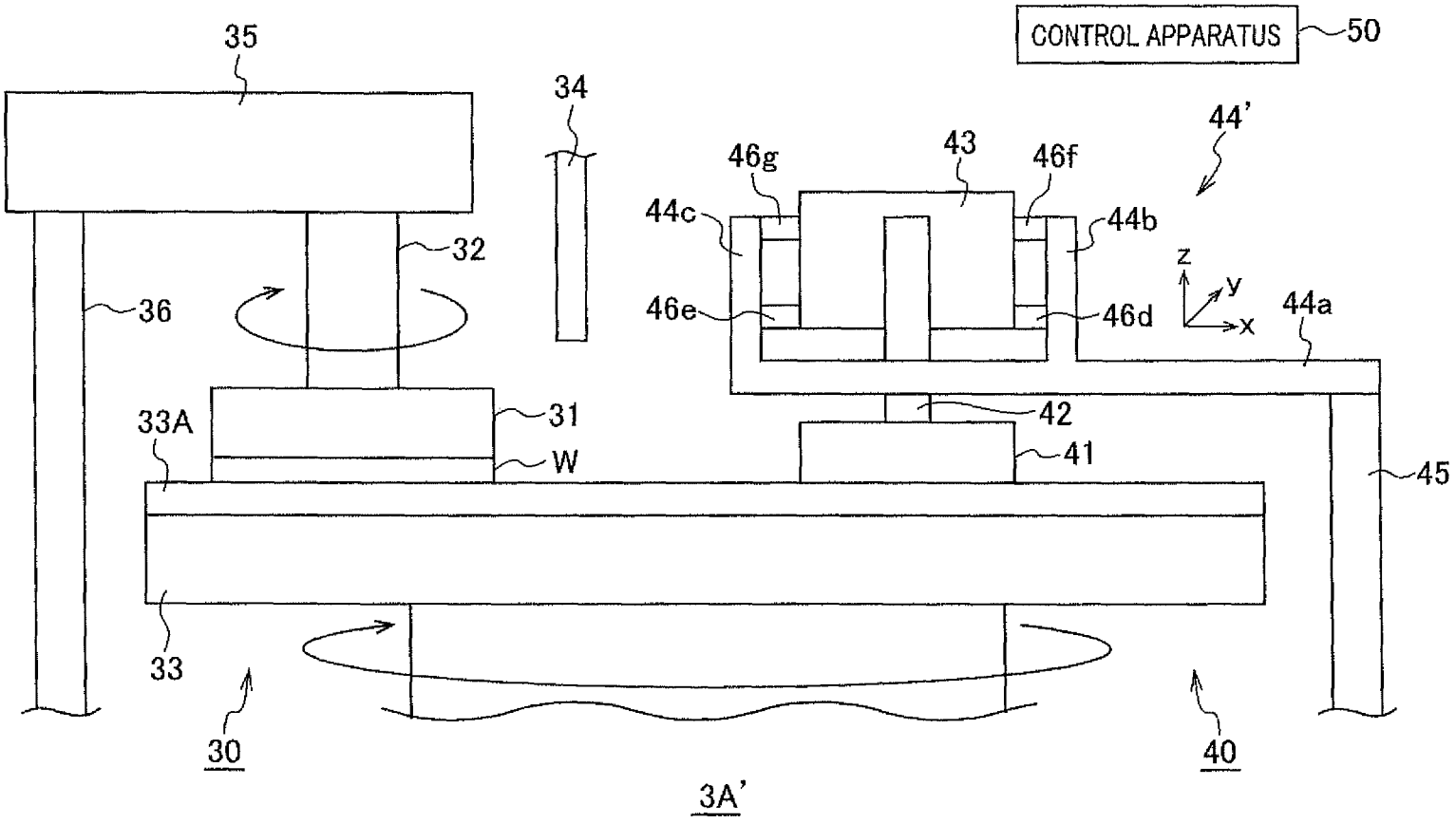
FIG. 7 is a schematic side view of a substrate polishing apparatus 3A' which is a modified example of FIG. 2.

FIG. 7 is a schematic side view of a substrate polishing apparatus 3A' which is a modified example of FIG. 2. A dresser arm 44' of the substrate polishing apparatus 3A' includes a base module 44*a* extending in the horizontal direction, a vertical module 44*b* which is located between the dresser drive module 43 and the turning shaft 45 and extends in the vertical direction from the base module 44*a*, and a vertical module 44*c* which extends in the vertical direction from the front end of the base module 44*a*.

The substrate polishing apparatus 3A' has four force sensors 46*d* to 46*g* which are provided so as to be able to allow a moment load generated by a force for the dresser 41 to dress the polishing pad 33A and which are disposed at the same distance from the center of the dresser shaft 42.

The force sensors 46*d* and 46*e* are on the same horizontal plane and are disposed between a lower side surface of the dresser drive module 43 and inner side surfaces of the vertical modules 44*b* and 44*c* of the dresser arm 44', respectively. The force sensor 46*d* is located opposite to the force sensor 46*e* with respect to the center of the dresser shaft 42.

The force sensors 46*f* and 46*g* are on the same horizontal plane, which is different from the plane on which the force sensors 46*d* and 46*e* are disposed, and are disposed between an upper side surface of the dresser drive module 43 and inner side surfaces of the vertical modules 44*b* and 44*c* of the dresser arm 44', respectively. The force sensor 46*f* is located opposite to the force sensor 46*g* with respect to the center of the dresser shaft 42.

Each of the force sensors 46*d* to 46*g* outputs information related to a force component in the x direction in which the base module 44*a* extends, a force component in the y direction perpendicular to the x direction, and a force component in the vertical direction.

The number of the force sensors and the disposition positions of the force sensors are not particularly limited as long as it is possible to monitor the force F for the dresser 41 to dress the polishing pad 33A in this way.

(Second Embodiment)

In the first embodiment described above, the force sensors 46*a* to 46*c* detect forces in three axis directions. On the other hand, in a second embodiment described below, force sensors that detect a force in the vertical direction (z direction) are used. Although a schematic side view of a substrate polishing apparatus 3A according to the present embodiment is nearly the same as that in FIG. 2, an example in which four force sensors 46*h* to 46*i* are used will be described. Hereinafter, differences from the first embodiment will be mainly described.

Figure 8A:
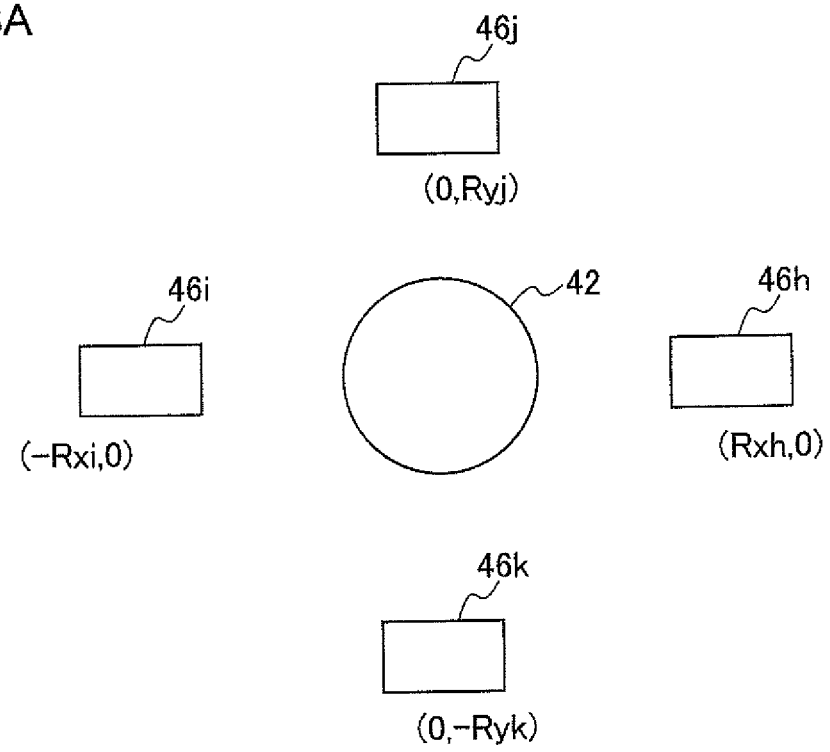
FIG. 8A is a schematic cross-sectional view of a substrate polishing apparatus 3A' passing through force sensors 46*h* to 46*k*, which is an example of a second embodiment.

FIG. 8A is a schematic cross-sectional view of a substrate polishing apparatus 3A' passing through force sensors 46*h* to 46*k*, which is an example of a second embodiment. When the center of the dresser shaft 42 is defined as the origin, coordinates where the force sensors 46*h* to 46*k* are disposed are (Rxh, 0), (−Rxi, 0), (0, Ryj), and (0, −Ryk), respectively. Here, Rxh=Rxi may be established and Ryj=Rhk may be established.

Figure 8B:
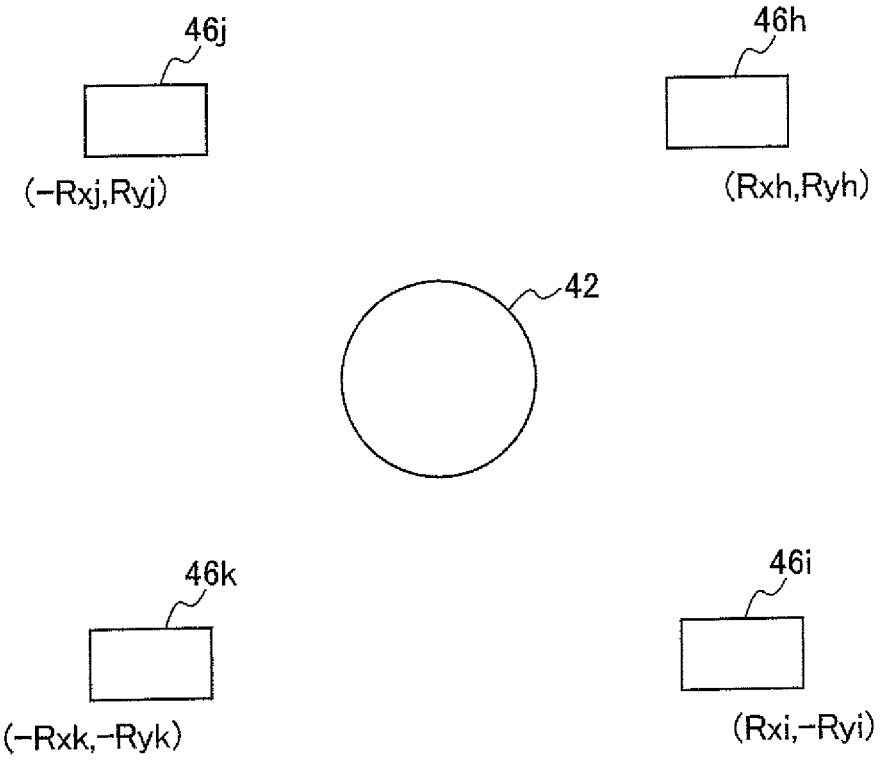
FIG. 8B is a schematic cross-sectional view of a substrate polishing apparatus 3A' passing through force sensors 46*h* to 46*k*, which is another example of the second embodiment.

FIG. 8B is a schematic cross-sectional view of a substrate polishing apparatus 3A' passing through force sensors 46*h* to 46*k*, which is another example of the second embodiment. Coordinates where the force sensors 46*h* to 46*k* are disposed are (Rxh, Ryh), (Rxi, −Ryi), (−Rxj, Ryj), and (−Rxk, −Rky). Here, Rxh=Rxi=Rxj=Rxk may be established and Ryh=Ryi=Ryj=Ryk may be established.

Of course, the dispositions of the force sensors shown in FIGS. 8A and 8B are merely examples. The force sensors may be disposed as described in the first embodiment, and the number of the force sensors and the positions of the disposed force sensors are not particularly limited.

In either of FIGS. 8A and 8B, the force sensors 46*h* to 46*k* respectively output information pieces Fzh' and Fzk' related to force components in the vertical direction (z direction). That is, the force sensors 46*h* to 46*k* need not necessarily be sensors that detect forces in three axis directions.

In FIG. 2, a distance between the lower surface of the dresser 41 and the force sensors 46*h* to 46*k* is defined as H.

In the present embodiment, the pad dressing force calculator 52 (see FIG. 4) in the control apparatus 50 calculates the dressing force F as follows. Here, the pad dressing force calculator 52 converts the output information pieces Fzh' and Fzk' from the force sensors 46*h* to 46*k* into forces Fzh to Fzk in the z direction in advance.

First, the pad dressing force calculator 52 calculates a moment load Mxn (n=h to k) around the x axis and a moment load Myn (n=h to k) around the y axis for each of the force sensors 46*h* to 46*k* based on the following formulas:

$$Mxn=Fzn*Ryn$$

$$Myn=Fzn*Ryn$$

Subsequently, the pad dressing force calculator 52 sums up the moment loads of all the force sensors 46*h* to 46*k* to calculate a moment load Mx around the x axis and a moment load My around the y axis. The calculations are as follows:

$$Mx=\Sigma Mxn=Mxh+Mxi+Mxj+Mxk$$

$$My=\Sigma Myn=Myh+Myi+Myj+Myk$$

Thereafter, the pad dressing force calculator 52 calculates an x component Fx and a y component Fy of the dressing force F based on the following formulas:

$$Fx=Mx/H$$

$$Fy=My/H$$

Subsequent processing is the same as that described in the first embodiment.

As described above, in the second embodiment, it is possible to monitor the force F for the dresser 41 to dress the polishing pad 33A at low cost by using the force sensors 46*h* to 46*k* that detect forces in one direction.

(Third Embodiment)

A third embodiment described below makes it possible to detect an abnormality of a force sensor.

A substrate polishing apparatus 3A according to the present embodiment has the force sensors 46*a* to 46*c* that detect forces in three axis directions in the same manner as in the first embodiment.

Therefore, in the same manner as described in the first embodiment, the pad dressing force calculator 52 can calculate Fx, Fy, |F|, and θ based on output information pieces Fxa' to Fxc' and Fya' to Fyc' related to the horizontal direction.

Further, in the same manner as described in the second embodiment, the pad dressing force calculator 52 can calculate Fx, Fy, |F|, and θ based on output information pieces Fza' to Fzc' related to the vertical direction.

Then, the determiner 56 compares the magnitude of force |F| based on output information related to the horizontal direction with the magnitude of force |F| based on output information related to the vertical direction. When a difference between both magnitudes exceeds a predetermined threshold value, the determiner 56 determines that a force sensor has an abnormality. The determiner 56 may compare Fx, Fy, and/or θ, instead of or in addition to the magnitudes of force |F|.

In this way, in the third embodiment, the force F is calculated by two methods, so that it is possible to detect an abnormality of force sensor.

(Fourth Embodiment)

In a fourth embodiment described below, a torque when the dresser 41 dress the polishing pad 33A (hereinafter referred to as a pad dressing torque) is calculated and monitored.

The pad dressing torque of the dresser may also be monitored based on a motor current of a mechanism that rotationally drives a dresser rotating shaft. However, the pad dressing torque obtained in this way includes a loss torque of a rotation driving mechanism and, thus, it is not possible to accurately monitor the pad dressing torque. Therefore, in the present embodiment, the following is performed. Hereinafter, the present embodiment will be described by using the force sensors 46*h* to 46*k* disposed as shown in FIG. 8A as an example.

A control apparatus 50 according to the present embodiment includes a pad dressing torque calculator (not illustrated) that calculates a pad dressing torque applied around the rotating shaft of the dresser 41, from output information pieces Fxh' to Fxk' and Fyh' to Fyk' related to the horizontal direction outputted from the force sensors 46*h* to 46*k* as well as position information of each of force sensors 46*h* to 46*k* from the rotating shaft center of the dresser 41. The pad dressing torque calculator converts the output information pieces Fxh' to Fxk' and Fyh' to Fyk' from the force sensors 46*h* to 46*k* into forces Fxh' to Fxk' and Fyh' to Fyk' in the horizontal direction in advance.

In FIG. 8A, when the rotating shaft center of the dresser 41, which is the center of the dresser shaft 42, is defined as the origin, coordinates where the force sensors 46*h* to 46*k* are disposed are (Rxh, 0), (−Rxi, 0), (0, Ryj), and (0, −Ryk), respectively, and these coordinates correspond to the above position information.

The pad dressing torque calculator calculates a torque Th applied around the rotating shaft of the dresser from forces Fxh and Fyh in the horizontal direction detected by the force sensor 46*h* and the above position information (coordinates) based on the following formula:

$$Th=Fxh*0+Fyh*Rxh$$

Similarly, formulas that obtain torques Ti, Tj, and Tk detected by the force sensors 46*i*, 46*j*, and 46*k* are as follows:

$$Ti=Fxi*0+Fyi*(-Rxi)$$

$$Tj=Fxj*Ryj+Fyj*0$$

$$Tk=Fxk*(-Ryk)+Fyk*0$$

Further, the pad dressing torque calculator calculates a pad dressing torque T around the rotating shaft of the dresser based on the following formula:

$$T=Th+Ti+Tj+Tk$$

While an example in which the force sensors 46*h* to 46*i* are disposed as shown in FIG. 8A has been described, the pad dressing torque calculator can calculate a pad dressing torque based on output information from each force sensor and position information (positional relation) between each sensor and the rotating shaft center of the dresser, regardless of the arrangement of the force sensors and the number of the force sensors.

As described above, in the fourth embodiment, it is possible to calculate the pad dressing torque T based on the output of the force sensors, so that it is possible to detect an accurate pad dressing torque that does not include a loss torque of the dresser rotation driving mechanism.

The embodiments described above are provided so that a person having an ordinary skill in the art to which the present invention pertains can implement the present invention. Various modified examples of the embodiments described above can be naturally implemented by those skilled in the art and the technical idea of the present invention can be applied to other embodiments. Therefore, the present invention is not limited to the described embodiments but should cover the largest range according to technical ideas defined by the claims.

What is claimed is:

1. A substrate polishing apparatus comprising:

a turntable configured to support a polishing pad;

a dresser configured to dress the polishing pad when the polishing pad is supported by the turntable;

a dresser drive module configured to press the dresser against the polishing pad and rotate the dresser;

a support member configured to support the dresser drive module; and a plurality of force sensors which are provided between the dresser drive module and the support member, each of the plurality of force sensors outputting information related to each of forces in three axis directions when the polishing pad is supported by the turntable and the polishing pad is dressed by the dresser.

2. The substrate polishing apparatus according to claim 1, wherein the plurality of force sensors are disposed at an identical distance from a center of rotation of the dresser and with an equal interval angle around the center of rotation of the dresser.

3. The substrate polishing apparatus according to claim 1, wherein the plurality of force sensors output:

first information related to a first force component in a first direction in a horizontal plane, second information related to a second force component in a second direction in the horizontal plane and perpendicular to the first direction, and third information related to a third force component in a direction perpendicular to the horizontal plane.

4. The substrate polishing apparatus according to claim 3, further comprising a first pad dressing force calculator that calculates the first force component in the first direction of a force for each position in the dresser corresponding to an installation position of each of the plurality of force sensors, to dress the polishing pad based on the first information outputted from each of the plurality of force sensors, and the second force component in the second direction of a force for each position in the dresser corresponding to the installation position of each of the plurality of force sensors, to dress the polishing pad based on the second information outputted from each of the plurality of force sensors.

5. The substrate polishing apparatus according to claim 3, further comprising a dresser pressure reaction force calculator that calculates a reaction force generated when each position in the dresser corresponding to an installation position of each of the plurality of force sensors presses the polishing pad, based on the third information outputted from each of the plurality of force sensors.

6. The substrate polishing apparatus according to claim 3, further comprising a pad dressing torque calculator that calculates a torque when the dresser dresses the polishing pad, based on the first information and the second information that are outputted from the plurality of force sensors and a positional relationship between each of the force sensors and a center of rotation of the dresser.

7. The substrate polishing apparatus according to claim 4, further comprising a second pad dressing force calculator that calculates a force when the dresser dresses the polishing pad, based on the first information and the second information that are outputted from the plurality of force sensors.

8. The substrate polishing apparatus according to claim 7, further comprising a determiner that performs abnormality determination by comparing a threshold value with a temporal variation of a magnitude of a force for the dresser to dress the polishing pad.

9. The substrate polishing apparatus according to claim 8, further comprising:

a dresser position calculator that calculates a position of the dresser on the polishing pad; and an output controller that identifies and outputs a position of the dresser on the polishing pad when an abnormality is determined, based on a calculation result of the dresser position calculator and a result of the abnormality by the determiner.

10. The substrate polishing apparatus according to claim 9, wherein the output controller performs output taking a number of times the abnormality is determined on the polishing pad into consideration.

11. The substrate polishing apparatus according to claim 7, wherein the second pad dressing force calculator calculates a magnitude and a direction of the force for the dresser to dress the polishing pad, based on the first information and the second information.

12. The substrate polishing apparatus according to claim 7, further comprising a work calculator that calculates at least one of a workload or a power of the dresser, based on the force when the dresser dresses the polishing pad.

13. The substrate polishing apparatus according to claim 12, further comprising:

a comparator that compares the at least one of the workload or the power to a threshold value; and a lifetime determiner that determines a lifetime of the dresser, based on a comparison result by the comparator.

14. A substrate polishing apparatus comprising:

a turntable configured to support a polishing pad;

a dresser configured to dress the polishing pad when the polishing pad is supported by the turntable;

a dresser drive module configured to press the dresser against the polishing pad and rotate the dresser;

a support member configured to support the dresser drive module;

a plurality of force sensors which are provided between the dresser drive module and the support member, each of the plurality of force sensors outputting first information related to a force component in a direction perpendicular to a horizontal plane when the polishing pad is supported by the turntable and the polishing pad is dressed by the dresser; and a pad dressing force calculator configured to calculate a force for the dresser to dress the polishing pad, based on the first information outputted from the plurality of force sensors and distances between each of the plurality of force sensors and a dressing surface of the dresser.

15. The substrate polishing apparatus according to claim 14, further comprising a determiner that performs an abnormality determination by comparing a threshold value with a temporal variation of a magnitude of the force for the dresser to dress the polishing pad.

16. The substrate polishing apparatus according to claim 15, further comprising:

a dresser position calculator that calculates a position of the dresser on the polishing pad; and an output controller that identifies and outputs a position of the dresser on the polishing pad when an abnormality is determined, based on a calculation result of the dresser position calculator and a result of the abnormality by the determiner.

17. The substrate polishing apparatus according to claim 16, wherein the output controller performs output taking a number of times the abnormality is determined on the polishing pad into consideration.

18. The substrate polishing apparatus according to claim 14, further comprising a work calculator that calculates at least one of a workload or a power of the dresser, based on the force for the dresser to dress the polishing pad.

19. The substrate polishing apparatus according to claim 18, further comprising:

a comparator that compares the at least one of the workload or the power to a threshold value; and a lifetime determiner that determines a lifetime of the dresser, based on a comparison result by the comparator.

* * * * *